US006430959B1

(12) United States Patent
Lifson

(10) Patent No.: US 6,430,959 B1
(45) Date of Patent: Aug. 13, 2002

(54) ECONOMIZER INJECTION PORTS EXTENDING THROUGH SCROLL WRAP

(75) Inventor: Alexander Lifson, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/073,511

(22) Filed: Feb. 11, 2002

(51) Int. Cl.[7] ..... F25B 31/00; F25B 43/02
(52) U.S. Cl. ..... 62/505; 62/468
(58) Field of Search ..... 62/115, 228.1, 62/228.3, 505, 510, 468; 418/55.5, 97

(56) References Cited

U.S. PATENT DOCUMENTS 4,475,360 A * 10/1984 Suefuji et al. ..... 62/324.1
5,103,652 A * 4/1992 Mizuno et al. ..... 62/505
5,329,788 A * 7/1994 Caillat et al. ..... 62/505
5,722,257 A * 3/1998 Ishii et al. ..... 62/505
5,996,364 A * 12/1999 Lifson et al. ..... 62/196.1
6,089,839 A * 7/2000 Bush et al. ..... 418/55.1
6,142,753 A 11/2000 Bush
6,171,086 B1 * 1/2001 Lifson et al. ..... 418/55.2
6,196,816 B1 * 3/2001 Lifson et al. ..... 418/55.6

* cited by examiner

*Primary Examiner*—Denise L. Esquivel
*Assistant Examiner*—Melvin Jones
(74) *Attorney, Agent, or Firm*—Carlson, Gaskey & Olds

(57) ABSTRACT

A scroll compressor is provided with economizer injection ports which extend through the wrap of one of the scroll members. Preferably the injection ports are formed through a so-called "hybrid" wrap which has a varying thickness. The other scroll member is provided with grooves in its base plate. The injection of economizer fluid occurs only during a portion of the orbiting cycle when the injection port and corresponding grooves are aligned with each other. However, as the orbiting cycle continues, the injection port will no longer be aligned with the groove. At that point, the injection is ceased. This allows a simple and precise way for valving the flow of the economizer fluid into the compression chambers.

10 Claims, 3 Drawing Sheets

ECONOMIZER INJECTION PORTS EXTENDING THROUGH SCROLL WRAP

BACKGROUND OF THE INVENTION

This application relates to placing economizer injection ports through the wrap of one of the scroll members in a scroll compressor.

Scroll compressors are becoming widely utilized in refrigerant compression applications. As known, a pair of scroll members have a base with a generally spiral wrap extending from the base. Typically, one scroll is non-orbiting and the other scroll orbits relative to the non-orbiting scroll. The orbiting scroll wrap contacts the non-orbiting scroll wrap to seal and define compression chambers. The compression chambers are moved toward a central discharge port as the orbiting scroll completes its orbiting cycle. Originally scroll compressors tended to have relatively thin wraps. More recently, so called "hybrid" wraps have been developed wherein the thickness of the wrap varies along its length.

Refrigerant systems are also making increasing use of an economizer cycle in which an additional heat exchange process occurs and a portion of the refrigerant is directed back to the compressor. At an intermediate point in the compression cycle, this refrigerant is injected into the compressor compression chambers through an economizer line and then into internal injection ports. This has the effect of increasing both system capacity and efficiency. The scroll compressor designer seeks to locate the internal injection ports to maximize the efficiency and capacity benefits as mentioned above.

The economizer ports have been formed through the base of the non-orbiting scroll penetrating into the compression chambers. Typically, the injection has occurred through economizer injection ports at a point in the compression cycle when the refrigerant is sealed off from suction to define a first compression chamber. After the seal off point, the injection ports continue to communicate with the compression chambers for a significant period of the cycle. Thus, the pressure within the compression chamber while initially relatively low soon increases. This increase in pressure inside compression chambers results in refrigerant being pumped back into the economizer line. This produces so called pumping losses, and hence decreased compressor efficiency which is undesirable.

SUMMARY OF THE INVENTION

In a disclosed embodiment of this invention, economizer fluid is injected into the compression chambers through ports formed within the wrap of one of the two scroll menibers. Most preferably, the injection ports are formed through the wrap of the non-orbiting scroll, which is most preferably of a "hybrid" profile such that it has varying thicknesses along its length.

The scroll member, which does not receive the injection ports in its wrap, has small grooves formed in the floor of its base plate. When the port is aligned with these grooves, economizer flow is injected into the compression chamber. However, once the orbiting scroll has moved such that the port is no longer aligned with the groove, the facing base plate closes the port off. In this way, the scroll compressor designer is able to easily control the "on/off" time for the economizer injection into the compression chamber. The grooves can be formed at a location such that the economizer ports are closed prior to the occurrence of significant pumping losses. Stated another way, the grooves can be formed such that the economizer injection port is open for a short period of time, and such that there is no back flow into the ports as the pressure inside the compression pockets increases.

These and other features of the present invention can be best understood from the following specification and drawings, the following of which is a brief description.

DETAILED DESCRIPTION OF A PREFERRED EMBODIMENT

Figure 1:
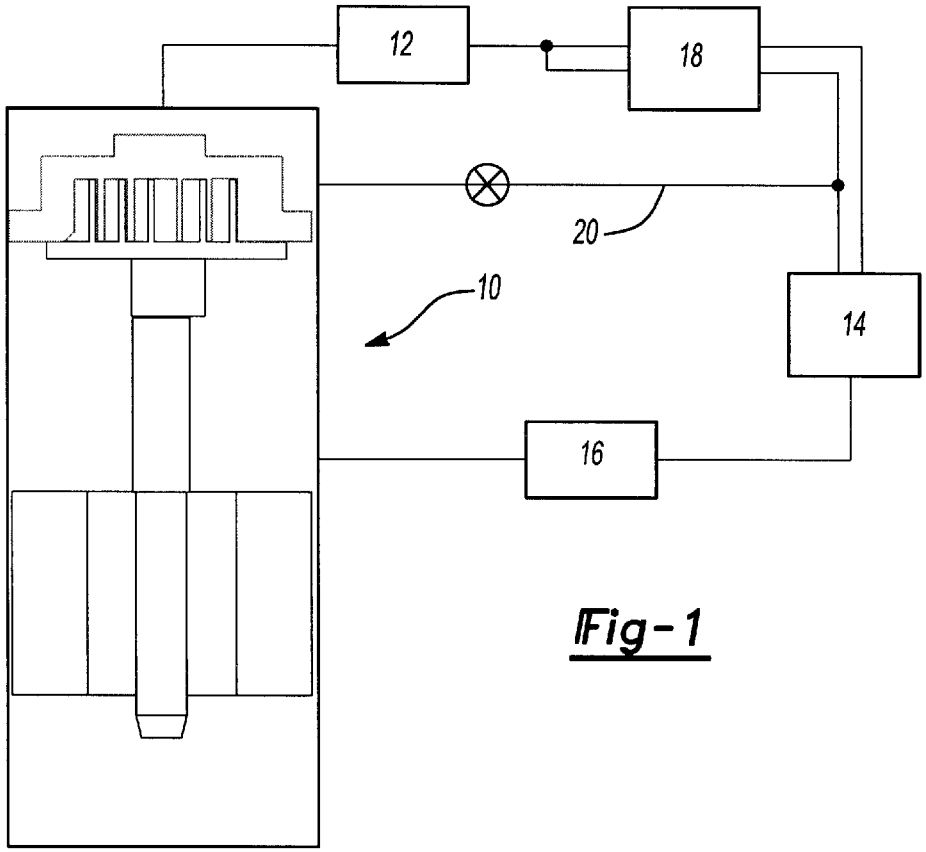
FIG. 1 is a schematic view of a refrigerant cycle incorporating a scroll compressor and an economizer cycle.

A refrigerant system 10 is illustrated in FIG. 1 having a compressor 11, an evaporator 16, an expansion valve 14, an expansion valve 15, and a condenser 12. As is shown, an economizer heat exchanger 18 communicates through an economizer injection line 20 back to the compressor.

Figure 2A:
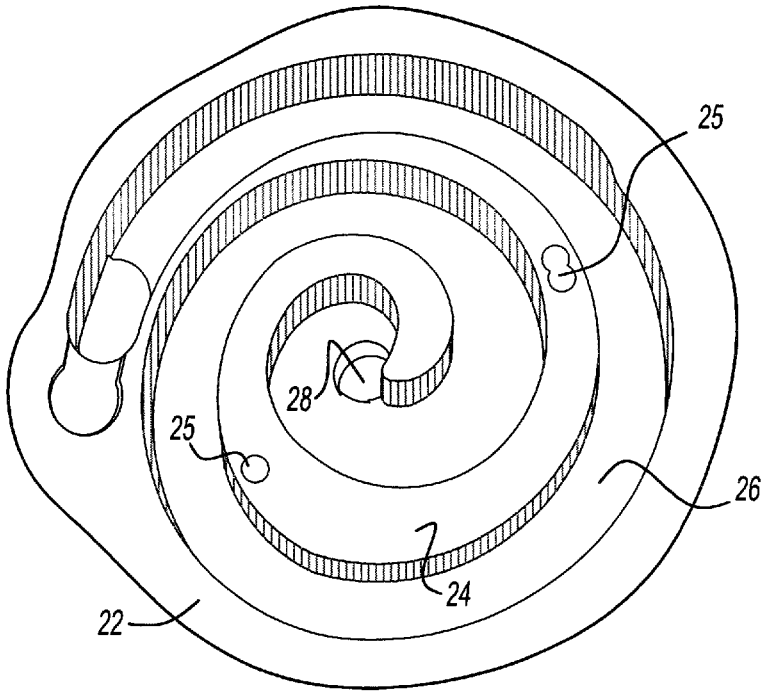
FIG. 2A is a front view of the non-orbiting scroll of the present invention.

As shown in FIG. 2A, a non-orbiting scroll 22 which is part of the compressor of FIG.1 includes a wrap 24, which is preferably "hybrid" as shown has a varying thickness along its circumferential extent.

Injection ports 25 are formed through the wrap 24. The injection ports may have a varying size. Further, the injection ports are preferably formed at a part of the wrap 24, which is not of its minimum thickness. The thicker wrap portions provides additional thickness such that an injection port of sufficient size can be formed through the wrap without compromising the structural integrity of the wrap. The base 26 of the non-orbiting scroll also carries a discharge port 28, as known.

Figure 2B:
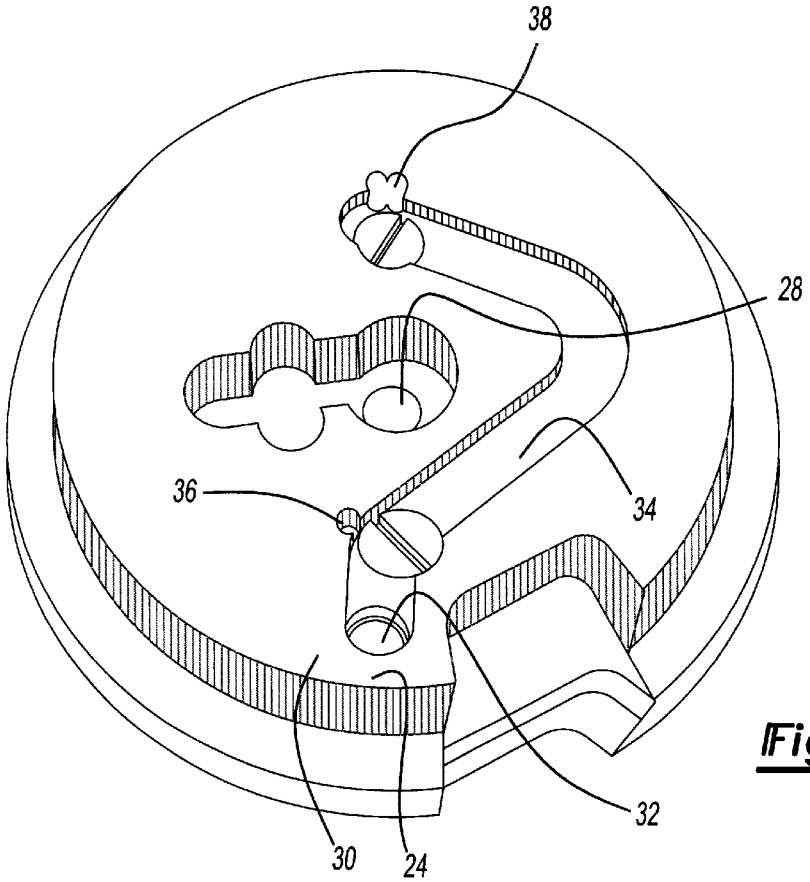
FIG. 2B is a view of the rear face of the non-orbiting scroll.

FIG. 2B shows the rear of the non-orbiting scroll 22. As shown, a rear face 30 includes a passage 32 which communicates with the economizer passage 20, as known. A groove 34 communicates with inlets 36 and 38 to the injection ports 25, shown in FIGS. 4A, 4B and 4C. As is known, fluid passes from the passage 20 into the passage 32, the groove 34, and communicate through the inlets 36 and 38 to the injection ports 25. As an example, see U.S. Pat. 6,142,753.

Figure 3:
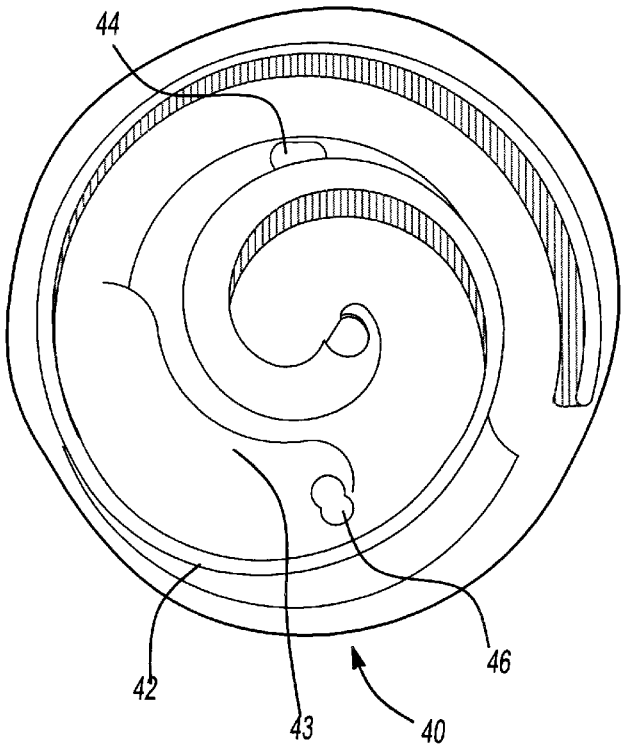
FIG. 3 shows the front face of the orbiting scroll.

As shown in FIG. 3, an orbiting scroll 40 includes a wrap 42 which is also of the hybrid shape, and which extends from a base 43. The base 43 includes grooves 44 and 46, cut into the base 43.

Figure 4A:
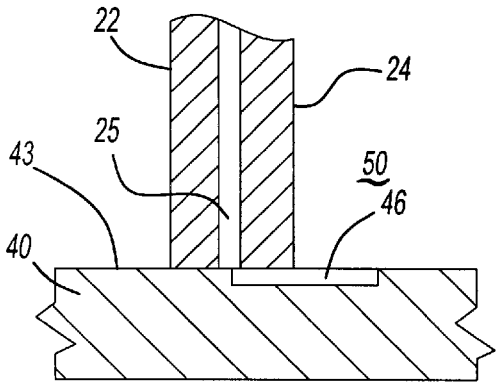
FIG. 4A shows one point in the cycle of the inventive scroll compressor.

As shown in FIG. 4A, during the operational cycle of the scroll compressor, the orbiting scroll 40 will move relative to the non-orbiting scroll 22, such that the base 43 of the orbiting scroll wrap 24 will slide over the tip 23 of fixed scroll wrap 24. As shown in FIG. 4A, the injection port 25 is not yet communicating with the groove 46. At this point, there will be no injection of economizer fluid into the compression chamber 50 since the passage 25 is closed by the base 43.

Figure 4B:
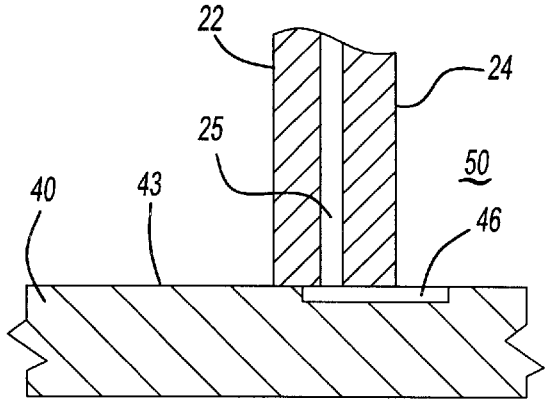
FIG. 4B shows a subsequent point.

With further orbiting movement, and as shown in FIG. 4B, the injection port 25 will align with the groove 46. At this point, economizer fluid will pass from the port 25 into the groove 46 and then from the groove 46 into the compression chamber 50.

Figure 4C:
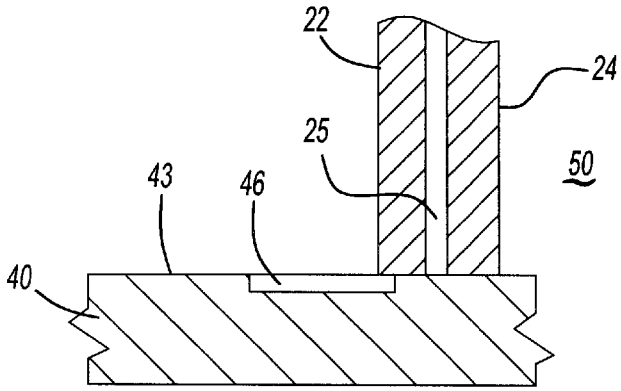
FIG. 4C shows yet another subsequent point.

As shown in FIG. 4C, with a small amount of additional movement, the port 25 is no longer aligned with the groove 46. Again, the face 43 of the orbiting scroll 40 now closes the passage 25. The economizer fluid will no longer be injected into this compression chamber.

In this fashion, a scroll compressor designer is able to control the timing and amount of fluid injection into the compression chambers. This control allows a significant increase in the efficiency of operation by reducing pumping losses while optimizing the amount of injected fluid.

While a preferred embodiment of this invention has been disclosed, a worker in this art would recognize that certain modifications come within the scope of this invention. For that reason the following claims should be studied to determine the true scope and content of this invention.

What is claimed is:

1. A scroll compressor comprising:

a first scroll member having a base and a generally spiral wrap extending from, said base;

a second scroll member having a base and a generally spiral wrap extending from its base, said second scroll member being driven to orbit relative to said first scroll member and said wraps of said first and second scroll members interfitting to define compression chambers; and an economizer passage communicating an economizer fluid into a housing for said scroll compressor, said economizer passage communicating with a supply passage in one of said first and second scroll members, said supply passage communicating with at least one injection port, said injection port forme d to extend through said wrap of said one of said first and second scroll members, and the other of said first and second scroll members being formed with at least one groove in said base to be selectively aligned with said injection port as said second scroll member orbits relative to said first scroll member to control the injection of economized fluid into said compression chambers.

2. A scroll compressor as recited in claim 1, wherein there are a pair of injection ports.

3. A scroll compressor as recited in claim 1, wherein there are two pairs of injection ports.

4. A scroll compressor as recited in claim 1, wherein said injection port extends through said wrap of said first scroll member.

5. A scroll compressor as recited in claim 1, wherein said wraps of said first and second scroll members have a non-uniform thickness along a circumferential direction.

6. A refrigerant cycle comprising:

a scroll compressor having first and second scroll members each having a base and a generally spiral wrap extending from said base, said generally spiral wraps interfitting to define compression chambers, said second scroll member being driven to orbit relative to said first scroll member, an economizer injection port formed through said wrap of one of said first and second scroll members, and the other of said first and second scroll members being provided with a groove in its base to be selectively aligned with said injection port during a portion of an orbiting cycle of said second scroll member to control the injection of an economizer fluid through said injection port into compression chambers defined by said wraps of said first and second scroll members;

a condenser downstream of said compressor, an expansion member downstream of said condenser, and an evaporator downstream of said expansion device; and an economizer heat exchanger selectively communicating a portion of a refrigerant downstream of said condenser back to said compressor, said economizer heat exchanger selectively communicating an economizer refrigerant through a passage which in turn communicates with said injection ports in said wrap of said one of said first and second scroll members.

7. A refrigerant cycle as set forth in claim 6, wherein said economizer injection port is formed through said wrap of said first scroll member.

8. A refrigerant cycle as set forth in claim 6, wherein there are a pair of economizer injection ports and a pair of said grooves.

9. A refrigerant cycle as set forth in claim 6, wherein there are two pairs of economizer injection ports and two pairs of said grooves.

10. A scroll compressor comprising:

a first scroll member having a base and a generally spiral wrap extending from said base;

a second scroll member having a base and a generally spiral wrap extending from its base, said second scroll member being driven to orbit relative to said first scroll member and said wraps of said first and second scroll members interfitting to define compression chambers, and wherein said wraps of said first and second scroll are of a hybrid shape such as they have a non-uniform thickness along a circumferential extent;

an economizer passage communicating an economizer fluid into a housing for said scroll compressor, said economizer passage communicating with a supply passage in said first scroll member, said supply passage communicating with at least one injection ports, said injection ports formed to extend through said wrap of said first scroll member, and said second scroll member being formed with at least one groove in its base to be selectively aligned with said injection port as said second scroll member orbits relative to said first scroll member to control the injection of economized fluid into said compression chambers.

* * * * *

UNITED STATES PATENT AND TRADEMARK OFFICE

CERTIFICATE OF CORRECTION

PATENT NO. : 6,430,959 B1
DATED : August 13, 2002
INVENTOR(S) : Lifson

It is certified that error appears in the above-identified patent and that said Letters Patent is hereby corrected as shown below:

Column 3,
Line 34, “forme d” should be -- formed --

Signed and Sealed this

Fourteenth Day of January, 2003

JAMES E. ROGAN
*Director of the United States Patent and Trademark Office*